United States Patent [19]

Miller

[11] 4,176,754

[45] Dec. 4, 1979

[54] PNEUMATIC BIASING DEVICE FOR PREVENTING AIR FROM ENTERING A NURSING BOTTLE

[76] Inventor: Diane Miller, 2241 NE. 34 Ct., Lighthouse Point, Fla. 33064

[21] Appl. No.: 918,409

[22] Filed: Jun. 23, 1978

[51] Int. Cl.[2] ..... A61J 9/00

[52] U.S. Cl. ..... 215/11 E; 29/110.5; 81/1 R; 215/100 R; 222/95

[58] Field of Search ..... 222/95, 101, 326, 386.5, 222/389; 100/179; 29/110.5, 113 R; 215/11 E, 11 R, 100 R; 81/1 R

[56] References Cited

U.S. PATENT DOCUMENTS

| | | | |
|---|---|---|---|
| 217,950 | 7/1879 | Langdon | 29/110.5 |
| 519,537 | 5/1894 | Kohout | 222/386.5 |
| 720,902 | 2/1903 | Du Brau | 222/95 |
| 775,089 | 11/1904 | McClenahan | 29/110.5 |
| 3,093,256 | 6/1963 | Woodbury | 215/11 R |
| 3,561,644 | 2/1971 | Works | 222/95 |
| 3,613,963 | 10/1971 | Berkmuller | 222/389 |
| 3,648,873 | 3/1972 | Grobbel | 215/11 E |
| 3,669,320 | 6/1972 | Purcell | 222/389 |
| 3,765,275 | 10/1973 | Johnson | 81/1 R |

*Primary Examiner*—Donald F. Norton
*Attorney, Agent, or Firm*—Barry L. Haley; Eugene F. Malin

[57] ABSTRACT

A device for improving dispensing of fluid from a nursing bottle that maintains the proper pressure to prevent an infant, while using the nursing bottle, from receiving air. The device is used with a conventional nursing bottle employing a flexible bag within the bottle structure and operates to provide a force against the bag to insure that no air is received in the bag, insuring that the infant, while feeding, receives no air. Specifically, the device includes a pneumatic biasing member which is inserted by an attached handle into the base opening of the nursing bottle and is placed in communication with the flexible bag containing the baby's formula. The pneumatic biasing member is pressed against the flexible bag to effectively regulate the proper fluid pressure within the bag such that an infant may feed from the nursing bottle without receiving air, with or without attendant supervision.

1 Claim, 4 Drawing Figures

Fig. 1.
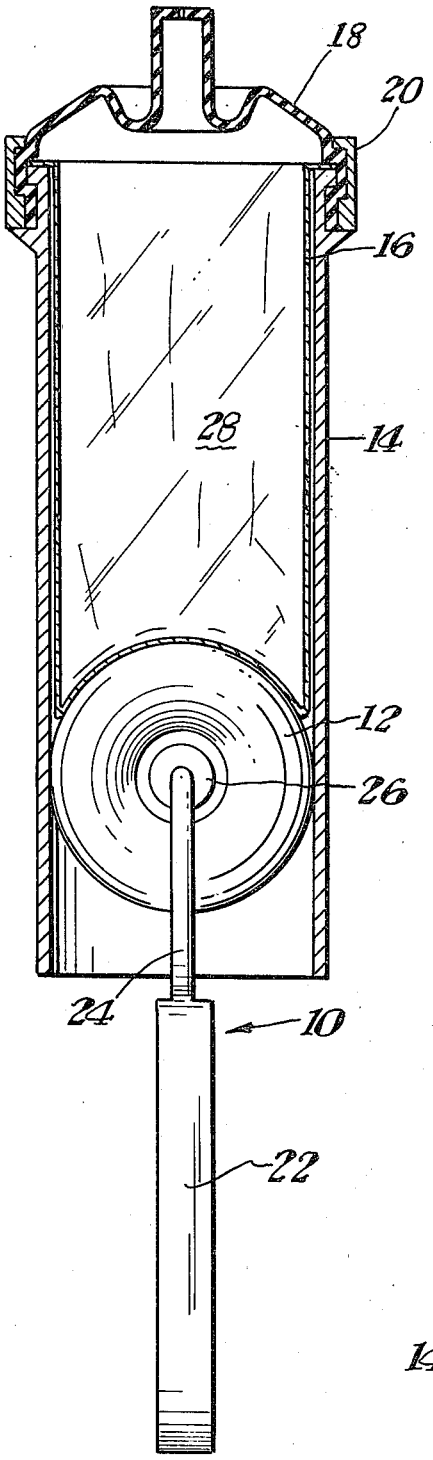
Fig. 2.
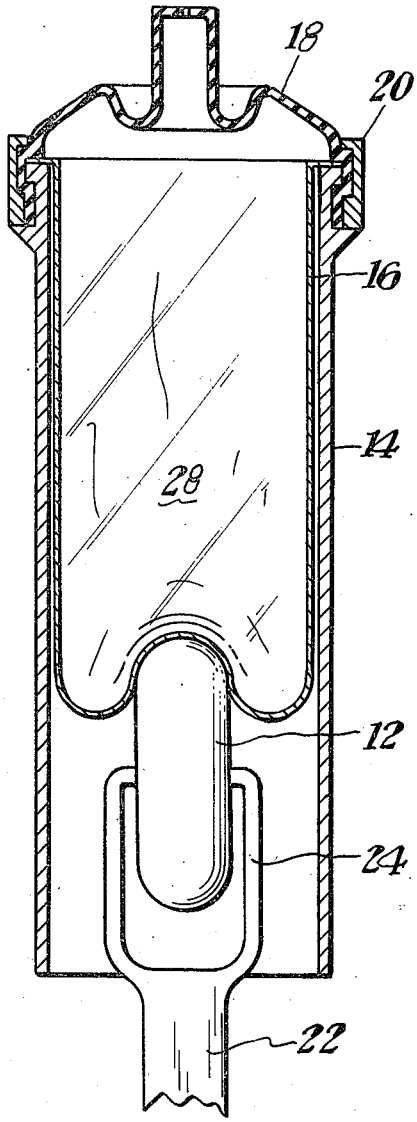
Fig. 3.
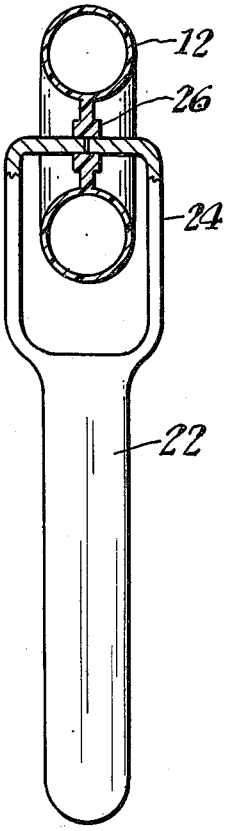
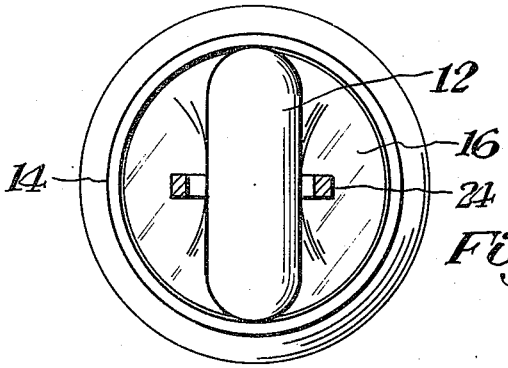
Fig. 4.

PNEUMATIC BIASING DEVICE FOR PREVENTING AIR FROM ENTERING A NURSING BOTTLE

BACKGROUND OF THE INVENTION

This invention relates generally to a device which may be used in conjunction with a conventional nursing bottle having a flexible bag for holding the formula to prevent receipt of air by the infant while feeding, with or without supervision.

One of the problems encountered with an infant while feeding from a bottle is that the infant often receives air along with the fluid, causing the child to receive a concentration of air in its stomach, resulting in severe gastric distress of the infant. Although conventional nursing bottles which use a flexible bag for containing the formula state that as the formula is consumed, no air is received into the flexible bag, it can be shown that as the child nurses from such a flexible bag, interrupted nursing allows air pressure to equalize in the flexible bag allowing air to enter the bag which ultimately will be drawn in by the baby while nursing. Another problem in using the flexible bag is that a certain amount of formula remains essentially unremoveable.

Attempts have been made in the prior art to overcome these problems by providing a biasing means on the flexible bag which creates a pressure on the liquid in the flexible bag. In U.S. Pat. No. 3,998,348 issued to Sammaritano, a complex biasing means is shown disposed in a conventional nursing bottle. The device shown is quite complex and does not insure for uniform biasing throughout the nursing operation.

The present invention overcomes the problems found in the prior art by providing a pneumatic biasing means that can be utilized with any conventional nursing bottle having a flexible bag that allows for manually adjusting the fluid pressure in the bag to the desired dispensing pressure so that the child can easily receive the liquid from the nursing bottle preventing air from being received into the flexible bag.

BRIEF DESCRIPTION OF THE INVENTION

A device for improving the dispensing characteristics of a nursing bottle having a flexible bag that holds the formula or milk to be dispensed, the device including a pneumatic member that is sized to compressionally and frictionally engage the inner surface of the bottle, said device having a handle for manual insertion adjustment and removal within the bottle inner shell. The pneumatic biasing member may be, in one embodiment, donut-shaped and made of a semi-pliable plastic material. The inner portion of the donut-shaped body includes a support wall connected to a bifurcated shaft connected to the handle.

In operation, the pneumatic biasing means is positioned manually by the handle longitudinally within the nursing bottle and in contact with the flexible bag containing the fluid such as formula or milk. The pneumatic member is diametrically sized to frictionally and compressionally engage the inner side wall of the bottle so that once positioned it will firmly remain in that fixed position relative to the bottle itself. Other portions of the pneumatic biasing means press against the flexible bag forcing the bag wall to deform in a volume reducing contour increasing the pressure of the fluid within the bag to a desired point. The exterior shape of the pneumatic biasing means allows it to cause the flexible bag to be contoured to the shape of the pneumatic member which itself is somewhat flexible, allowing the two surfaces to achieve uniform contact throughout insuring that no portion of the flexible bag is allowed to expand which might allow air to be received into the bag. After a period of time, while the infant is nursing from the bottle and the fluid is displaced, the pneumatic biasing member will expand, compensating for displacement of the fluid received by the infant. After a relatively large volume of fluid has been dispensed to the infant, it will become necessary for the supervisor to readjust the pneumatic member to insure maintenance of the proper fluid pressure to prevent air from being received in a bag. Although a donut-shaped pneumatic member has been disclosed in the preferred embodiment, other shaped members such as hemispherical, spherical, elipsoidal pneumatic members may be employed.

It is an object of this invention to provide an improved dispensing regulator for a nursing bottle employing a flexible bag.

It is another object of this invention to employ a pneumatic biasing member which is used to bias the fluid pressure in a conventional nursing bottle having a flexible bag to prevent the receipt of air into the flexible bag during the nursing operation by the baby, and insure complete exhaustion of all fluid from the flexible bag for each feeding operation.

And yet, still another object of this invention is to provide a device which may be readily used with a conventional nursing bottle having a flexible bag by manual insertion and removal to allow for precise fluid pressure adjustment in the nursing bottle.

In accordance with these and other objects which will be apparent hereinafter, the instant invention will now be described with particular reference to the accompanying drawings.

BRIEF DESCRIPTION OF THE DRAWINGS

FIG. 1 shows a side elevational view of the instant invention as employed in a conventional nursing bottle, in cross-section.

FIG. 2 is an end elevational view of the instant invention employed in a conventional nursing bottle in cross-section.

FIG. 3 is an end elevational view of the instant invention, partially in cross-section.

FIG. 4 is a bottom plan view of the instant invention with the lower end of the handle removed.

PREFERRED EMBODIMENT OF THE INVENTION

Referring now to the drawings, and specifically FIG. 1, the instant invention is shown generally at 10 disposed within a conventional nursing bottle 14 having a flexible bag 16 disposed therein which contains the fluids to be consumed by the infant. The bag 16 is retained in the bottle 14 by an annular retainer 20 which is received over the upper end of the bottle which also holds a nipple 18 thereto and the upper open portions of the bag 16.

The invention includes a pneumatic donut-shaped member 12 having an inner support surface 26 in the inner portion of the donut hole connected to a bifurcated shaft 24 terminating and coupled to handle 22. The outer diameter of the pneumatic member 12 is such that it is slightly larger than the inner diameter of bottle 14 so that the pneumatic member 12, when inserted within the chamber 28 of bottle 14, will itself be compressed and frictionally retained in whatever position it is placed.

Referring now to FIG. 2, the invention is shown such that the donut-shaped member 12 is in contact with the bottom of bag 16 such that the bag surface conforms to and is recessed by member 12. Thus, the pneumatic member 12 pressed against the flexible bag 16 which forms over the pneumatic member's outer surface in a contour relationship insures equal distribution of pressure throughout the flexible bag and within the liquid chamber 28. Pressing upwardly on the pneumatic member with handle 22, the operator can increase the fluid pressure within the flexible bag 16 to a point that will allow the infant to receive the fluid while preventing air from being received into the chamber 28. As fluid is dispensed from the chamber 28 in bag 16, the pneumatic member 12 will expand and press against the bag 16 to displace in volume fluid withdrawn from the bag reducing the volume of the bag to insure that air will not be received into the chamber 28.

FIG. 3 shows the instant invention including the pneumatically sealed member 12 which is donut-shaped, having a hollow interior and includes a support wall 26 which is used to connect the pneumatic donut-shaped member to a bifurcated shaft 24 connected to handle 22. FIG. 4 shows the member 12 from the bottom of the bottle pushing against bag 16.

The pneumatic member could be made of other shapes which deform the shape of the flexible bag and expand accordingly as fluid is displaced and dispensed.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A device for preventing air from being received into the flexible bag in a conventional nursing bottle, comprising:

a pneumatic biasing means, said pneumatic biasing means being sized to be frictionally engaged in the inside of a conventional nursing bottle;

a means connected to the biasing means for manually positioning the biasing means within said nursing bottle;

said pneumatic biasing means being donut-shaped and having an outer diameter which is slightly greater than the inner diameter of a conventional nursing bottle.

* * * * *